US011777270B2

(12) United States Patent
D'Antuono

(10) Patent No.: US 11,777,270 B2
(45) Date of Patent: Oct. 3, 2023

(54) DIELESS UTILITY CRIMPER

(71) Applicant: Milwaukee Electric Tool Corporation, Brookfield, WI (US)

(72) Inventor: Marc S. D'Antuono, Whitefish Bay, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 17/397,153

(22) Filed: Aug. 9, 2021

(65) Prior Publication Data

US 2022/0045468 A1 Feb. 10, 2022

Related U.S. Application Data

(60) Provisional application No. 63/062,519, filed on Aug. 7, 2020.

(51) Int. Cl.
*H01R 43/058* (2006.01)
*H01R 43/042* (2006.01)

(52) U.S. Cl.
CPC ..... *H01R 43/058* (2013.01); *H01R 43/0427* (2013.01)

(58) Field of Classification Search
CPC ..... H01R 43/058; H01R 43/0427; H01R 43/0428; B25B 27/026; B25B 27/10; B21D 39/048; Y10T 29/53209; Y10T 29/53235; Y10T 29/5327
USPC ..... 29/747, 761
See application file for complete search history.

(56) References Cited

U.S. PATENT DOCUMENTS

| | | | | |
|---|---|---|---|---|
| 4,604,890 | A * | 8/1986 | Martin | H01R 43/0427 72/30.1 |
| 5,113,679 | A | 5/1992 | Ferraro et al. | |
| 5,490,406 | A | 2/1996 | College | |
| 5,727,417 | A | 3/1998 | Moffatt et al. | |
| 6,378,194 | B1 | 4/2002 | Ngheim | |
| 6,457,338 | B1 | 10/2002 | Frenken | |
| 6,501,719 | B1 | 12/2002 | Hada et al. | |
| 6,662,621 | B1 | 12/2003 | Amherd | |
| 8,056,473 | B2 | 11/2011 | Frenken | |
| 9,180,583 | B2 | 11/2015 | Frenken | |
| 9,270,072 | B2 * | 2/2016 | Westley | H01R 43/0427 |
| 2001/0007202 | A1 | 7/2001 | Frenken | |
| 2001/0032490 | A1 | 10/2001 | Goop | |
| 2002/0148274 | A1 | 10/2002 | Goop | |
| 2003/0066324 | A1 | 4/2003 | Goop | |

(Continued)

FOREIGN PATENT DOCUMENTS

| | | |
|---|---|---|
| EP | 0417024 A1 | 3/1991 |
| EP | 0941813 A1 | 9/1999 |

*Primary Examiner* — Donghai D Nguyen
(74) *Attorney, Agent, or Firm* — Quarles & Brady LLP

(57) ABSTRACT

Embodiments of the invention provide a crimper for use in a tool. The crimper can include a clevis, a nest, and an indenter. The clevis can include a first leg having a first slot and a second leg having a second slot. The first leg and the second leg can extend from a cylindrical body that has a base surface. The indenter can be configured to be moved from a retracted position to an extended position. The indenter can include a body with a work surface and a base on opposing sides of the body. The base of the indenter can be configured to engage the base surface of the cylindrical body when the indenter is in the retracted position.

20 Claims, 6 Drawing Sheets

(56) References Cited

U.S. PATENT DOCUMENTS

| | | | |
|---|---|---|---|
| 2010/0300308 | A1 | 12/2010 | Frenken |
| 2011/0247506 | A1 | 10/2011 | Frenken |
| 2014/0260505 | A1 | 9/2014 | Bowles et al. |
| 2016/0023419 | A1 | 1/2016 | Frenken |
| 2016/0031042 | A1 | 2/2016 | Gietzelt et al. |
| 2016/0078338 | A1 | 3/2016 | Glockseisen |
| 2016/0363510 | A1 | 12/2016 | Kanack et al. |
| 2017/0252911 | A1 | 9/2017 | Barezzani et al. |
| 2017/0302044 | A1 | 10/2017 | Lefavour et al. |
| 2017/0355027 | A1 | 12/2017 | D'Antuono |
| 2018/0093319 | A1 | 4/2018 | Skinner et al. |
| 2019/0123502 | A1 | 4/2019 | Lefavour et al. |
| 2021/0408749 | A1 | 12/2021 | Keller et al. |

* cited by examiner

DIELESS UTILITY CRIMPER

RELATED APPLICATIONS

This application claims priority to U.S. provisional patent application No. 63/062,519, titled Dieless Utility Crimper and filed Aug. 7, 2020, the entirety of which is incorporated herein by reference.

BACKGROUND

Crimpers and cutters often include a crimping or cutting head and certain crimping and cutting features, depending on the particular configuration of the tool. Some crimpers and cutters are hydraulic power tools that include a piston that can exert force on the crimping head, which may be used to move crimping features to perform crimp or compression work at a targeted crimp location. The size of the crimping and cutting features, as well as their material composition, affect the weight and usability of the tool. In some cases, it may be useful to have a lighter weight crimper or cutter tool.

SUMMARY

Embodiments of the invention provide a crimper head for use in a tool. In one embodiment, the crimper head includes a clevis and an indenter. The clevis includes a body having a base surface, a first leg having a first inner surface and a first curved transition area adjacent to the base surface, a second leg having a second inner surface and a second curved transition area adjacent to the base surface, a first slot formed in the first leg that partially extends into the first inner surface, and a second slot formed in the second leg that partially extends into the second inner surface. The indenter is moveable between a retracted position and an extended position. The indenter includes a first arm disposed within the first slot and a second arm disposed within the second slot.

In some embodiments, a crimper head includes a clevis, a nest assembly, and an indenter. The clevis includes a first leg having a first slot and a second leg having a second slot, the first leg and the second leg extending from a cylindrical body. The nest is releasably coupled to the first leg within the first slot. The indenter includes a body having a work surface and a base, with the work surface on an opposing side of the body from the base. The base is configured to engage the base surface of the cylindrical body of the clevis.

Some embodiments of the invention provide a crimper head for use in a tool. The crimper head can include a clevis, a nest assembly, and an indenter. The clevis can include a first leg having a first slot and a second leg having a second slot. The first and second legs can extend from a cylindrical body having a base surface. The nest can be releasably coupled to the first leg within the first slot. The indenter can include a body having a work surface and a base, the work surface on an opposing side of the body from the base. The base can be configured to engage the base surface of the cylindrical body in a retracted position.

Some embodiments of the invention provide a crimper head for use in a tool. The crimper head can include a clevis, a nest, and an indenter. The clevis can define a clevis body and include first and second legs having respective first and second inner surfaces, first and second slots formed at least partially in the respective first and second inner surfaces, and first and second ledges extending perpendicular to the respective first and second surfaces within the respective first and second slots. The nest can include a first end and a second end. Each of the first end and the second end can be configured to be secured to the clevis body adjacent to the respective first and second ledges. The indenter can be moveable between a retracted position and an extended position and can include first and second opposing arms. The first and second opposing arms can be configured to extend into the respective first and second slots and extend distally beyond the respective first and second ledges when the indenter is in the extended position.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
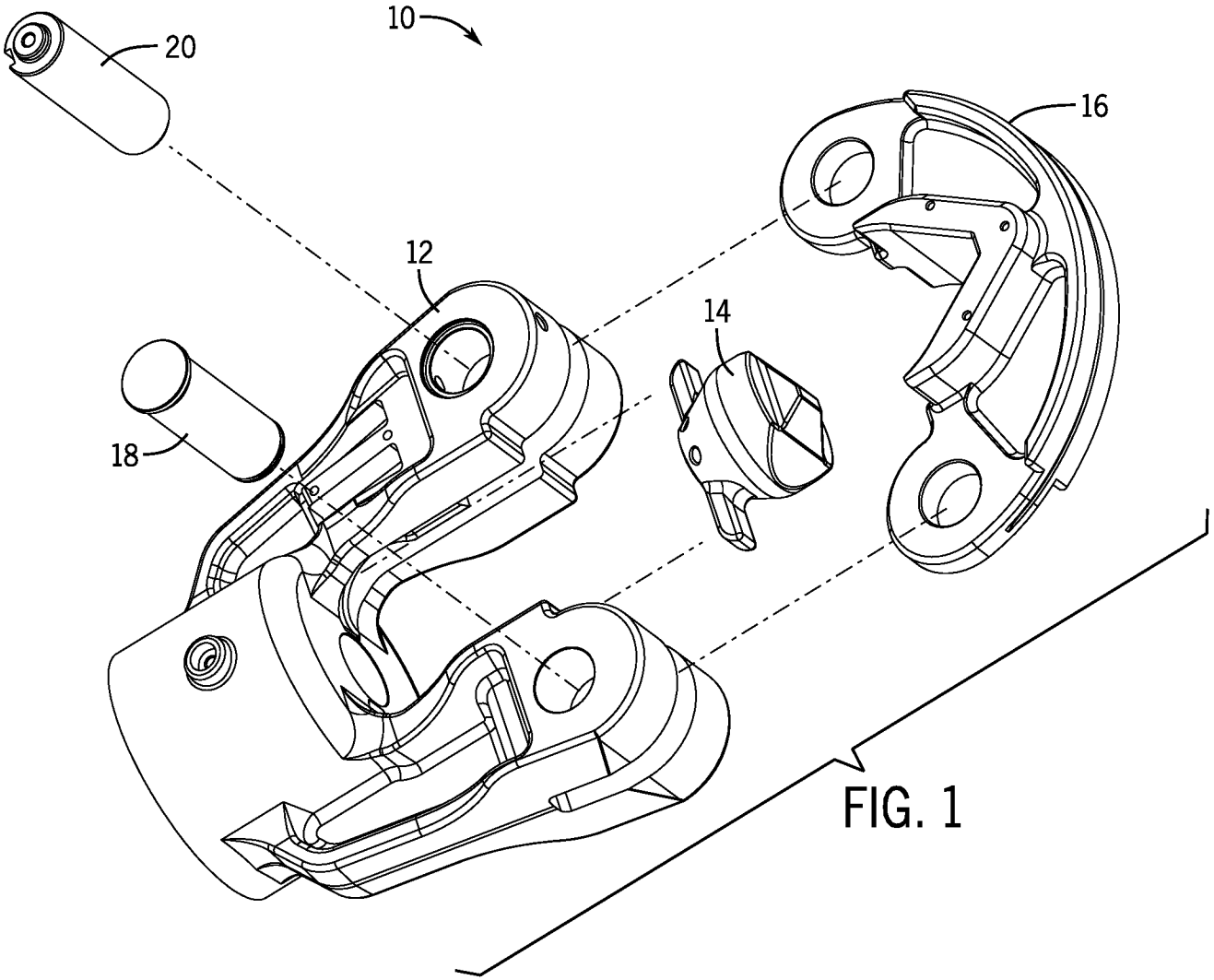
FIG. 1 is an exploded isometric view of a crimper head including a clevis, an indenter, and a nest according to one embodiment of the invention.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

As used herein, unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

A dieless crimper head for using with a crimping and cutting tool is described below. Some crimpers, including the dieless crimper described below, employ an indenter to create a certain size indent on a certain type of crimp operation. It can generally be useful to have a lightweight crimping or cutting tool. For example, a lightweight and maneuverable tool that can be used one-handed may be useful to perform repetitive crimps. Additional scenarios where it may be useful to have a lightweight, compact crimping tool are possible. For example, a lightweight compact crimping tool can be useful to perform crimps in limited-access environments, such as within an enclosure or an area crowded with various components.

FIG. 1 illustrates a crimper head 10 according to one embodiment of the invention. In some embodiments, the crimper head 10 may be used with a hydraulic hand tool. For example, the crimper head 10 may be used with a utility crimper. As shown in FIG. 1, the crimper head 10 includes a clevis 12, an indenter 14, and a nest 16. The crimper head 10 further includes a pivot pin 18 and a nest pin 20 that secure the nest 16 to the clevis 12.

Figure 2:
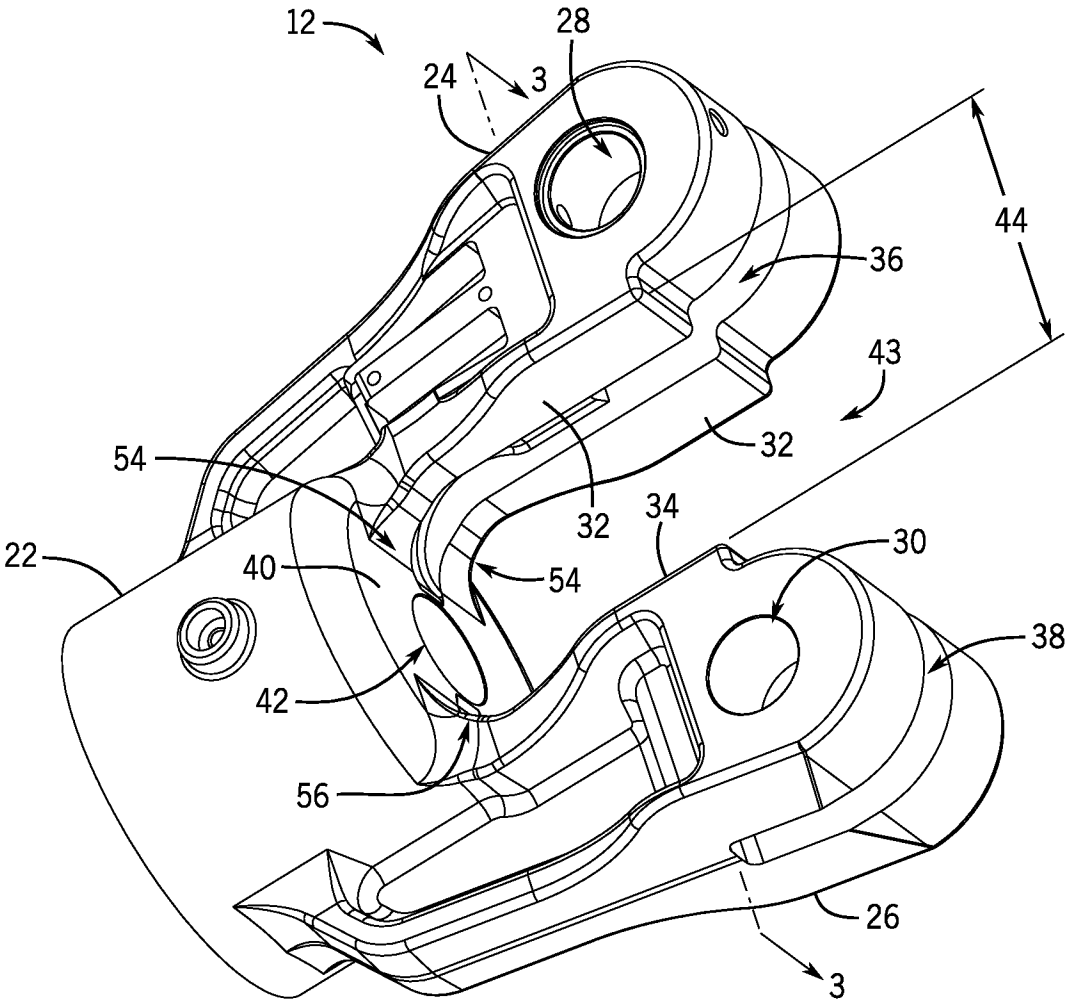
FIG. 2 is an isometric view of the clevis of FIG. 1

FIG. 2 illustrates the clevis 12 of FIG. 1. The clevis 12 includes a body 22 with a first leg 24 and a second leg 26. Each of the first leg 24 and the second leg 26 include a first aperture 28 and a second aperture 30, respectively. Further, each of the first leg 24 and the second leg 26 include a first inner surface 32 and a second inner surface 34. The first leg 24 includes a first slot 36 that partially extends into the first inner surface 32. Similarly, the second leg 26 includes a second slot 38 that partially extends into the second inner surface 34. The body 22 is a generally cylindrical portion that includes a base surface 40 with a base aperture 42 formed therein.

The first leg 24 and the second leg 26 extend from the body 22 and define a work zone 43. Each of the first slot 36 and the second slot 38 extend beyond the first inner surface 32 and the second inner surface 34, respectively, outside of the work zone 43. A portion of the first inner surface 32 is generally parallel to a portion of the second inner surface 34. A clevis width is defined as a segment perpendicular to each of the first inner surface 32 and the second inner surface 34. The clevis width can be defined at any number of points between the first leg 24 and the second leg 26. By way of example, a clevis width 44 is illustrated in FIGS. 2 and 3.

Proximate to the base surface 40, each of the first inner surface 32 and the second inner surface 34 have a first smooth transition area 54 and a second smooth transition area 56, respectively. The first smooth transition area 54 and the second smooth transition area 56 can reduce the stress concentration of the clevis 12, particularly when compared to an alternative transition area having a relatively sharper corner. In general, the smooth transition areas 54, 56 provide a continuous curved surface between the respective inner surfaces 32, 34 and the base surface 40. In some embodiments, the smooth transition areas 54, 56 can define a radius of curvature between 0.2 inches and 1.2 inches, or between 0.4 inches and 0.6 inches. In some embodiments, the first inner surface 32 is planar (i.e., a curved plane) with the base surface 40 and the second inner surface 34 is planar with the base surface 40.

Figure 3:
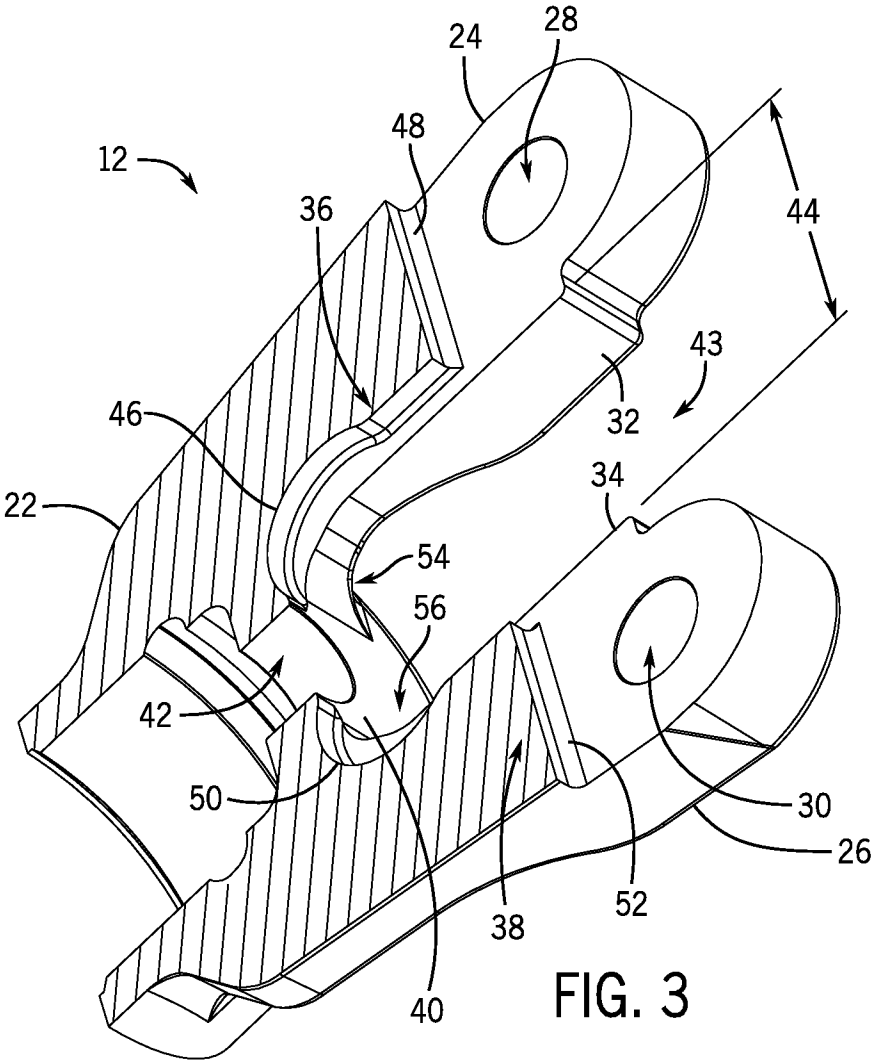
FIG. 3 is a cross-sectional isometric view of the clevis taken through line 3-3 of FIG. 2.

FIG. 3 illustrates a cross section of the clevis 12 of FIG. 2. The first slot 36 includes a first undercut 46 adjacent to the base surface 40 and a first ledge 48, that, when the crimper head 10 is assembled, is adjacent to the nest 16. Similarly, the second slot 38 includes a second undercut 50 adjacent to the base surface 40 and a second ledge 52, that, when the crimper head 10 is assembled, is adjacent to the nest 16 (see, for example, FIG. 7). Each of the first and second ledges 48, 52 extend in a direction that is generally parallel to the base surface 40. The first undercut 46 and the second undercut 50 each provide an arcuate surface that extends laterally into the first leg 24 and the second leg 26, respectively.

Figure 5:
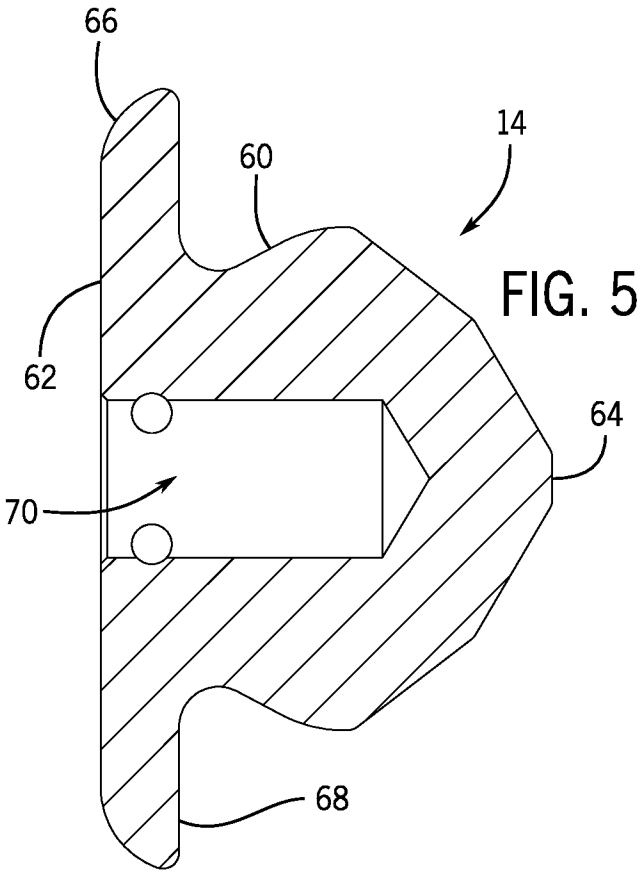
FIG. 5 is a cross-sectional side view of the indenter taken through line 5-5 of FIG. 4.
Figure 4:
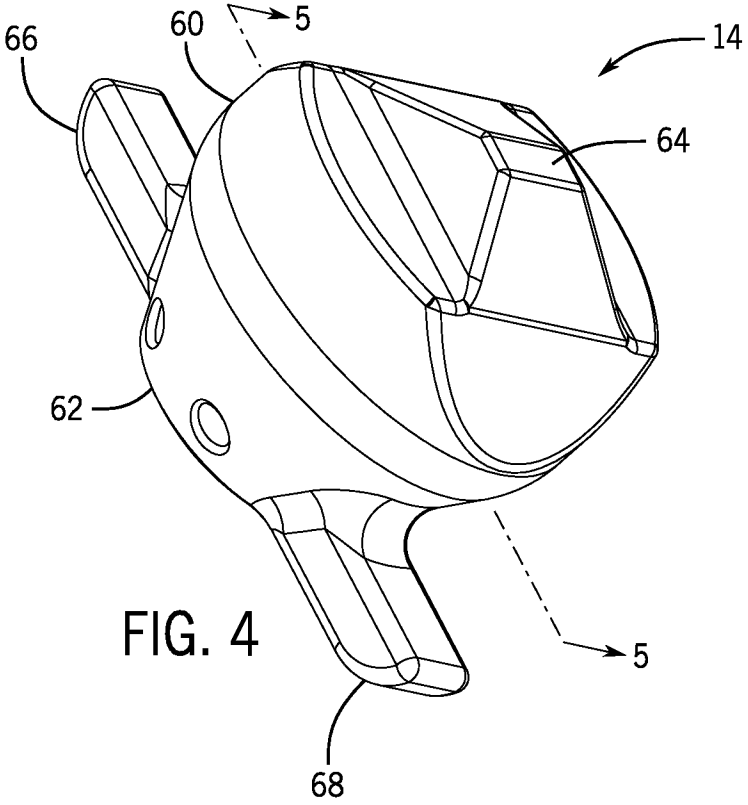
FIG. 4 is an isometric view of the indenter of FIG. 1.

FIGS. 4 and 5 illustrate the indenter 14 of FIG. 1. The indenter 14 includes a body 60 that defines a base 62 and a work surface 64. A first arm 66 and a second arm 68 extend radially on opposing sides of the body 60. In the illustrated example, the work surface 64 includes a tapered surface that is dimensioned to provide a specified crimp indentation profile. Other examples of a work surface can include one or more of tapered surface, faceted surface, planar surface, or curved surface. In some embodiments, the indenter 14 can act as a die in the crimper head 10 so that the indenter 14 may be interchangeable within the crimper head 10 to provide additional or alternative indenter geometries.

As further illustrated in FIG. 5, the indenter 14 includes a fastener recess 70 formed in the base 62 and extends toward the work surface 64 within the indenter 14. In some embodiments, the fastener recess 70 is internally threaded. The fastener recess 70 is configured to receive a fastener (not shown) that extends through the base aperture 42 to couple the indenter 14 to the hydraulic tool adjacent to the base aperture 42 and the base surface 40 of the clevis 12 when in a retracted position (see, for example, FIGS. 6 and 7).

Figure 6:
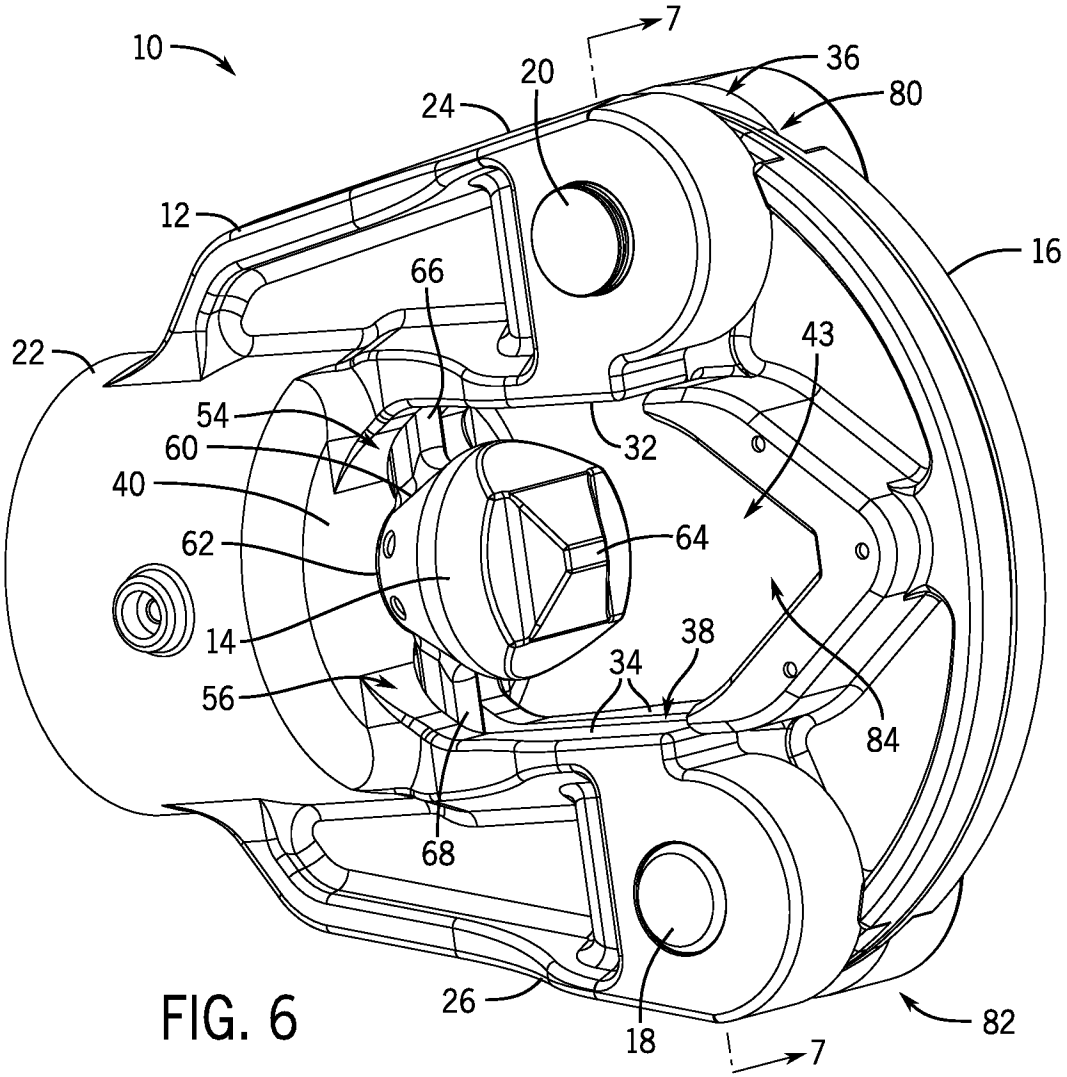
FIG. 6 is an isometric view of the crimper head of FIG. 1.
Figure 7:
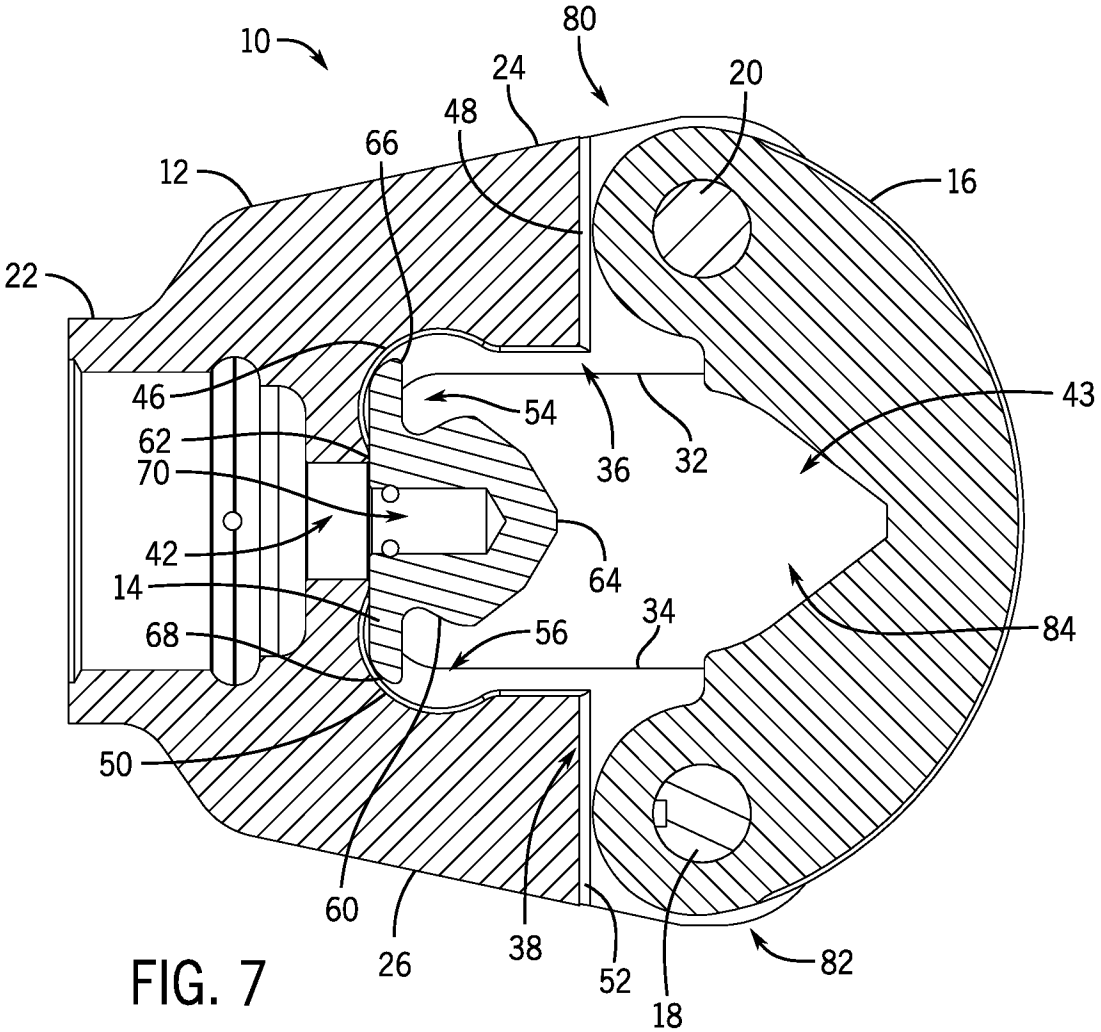
FIG. 7 is a cross-sectional side view of the crimper head of FIG. 6.

FIGS. 6 and 7 illustrate the crimper head 10 in the retracted position. In the retracted position, the base 62 of the indenter 14 is adjacent to, and at least partially engaged with, the base surface 40 of the body 22. Further, the first arm 66 is seated within the first undercut 46 and the second arm 68 is seated in the second undercut 50. The indenter 14 is configured to move from the retracted position to an extended position. In some embodiments, the indenter 14 is moved from the retracted position to the extended position via a hydraulic piston. When moving from the retracted position to the extended position, the first arm 66 and the second arm 68 are guided along the first slot 36 and the second slot 38, respectively. The orientation of the indenter 14 is controlled by the first slot 36 and the second slot 38. In the extended position, the base 62 is moved away from the base surface 40 of the body 22, and the work surface 64 is moved toward the nest 16.

In some embodiments, the nest 16 is configured as a latch assembly. The nest 16 is configured to pivot with respect to the clevis 12 at the pivot pin 18. The pivot pin 18 extends through the second aperture 30 of the second leg 26 and the nest 16 at a second end 82. Correspondingly, the nest pin 20 extends through the first aperture 28 of the first leg 24 and the nest 16 at a first end 80. The nest pin 20 is configured to releasably secure the nest 16 to the clevis 12. In use, the first end 80 of the nest 16 may be released from the clevis 12 and a work piece intended to be crimped may be inserted into the work zone 43 that is bound laterally by the first leg 24 and the second leg 26. The nest 16 may then be secured to the clevis 12 and the word zone 43 may be further bound distally by the nest 16.

The nest 16 includes a body having an arcuate exterior and a receiving area 84 opposite the arcuate exterior. The receiving area 84 of the nest 16 is configured to face the work zone 43 when the nest 16 is secured in a closed position relative to the clevis 12 (see, for example, FIG. 6). In some embodiments, the receiving area 84 defines a generally V-shaped profile configured to receive a work piece. In use, an actuator may initiate the indenter 14 to move from the retracted position to an extended position. The work surface 64 may engage a work piece within the work zone 43, which may engage the receiving area 84 of the nest 16, and provide a crimp at a predetermined force. The indenter 14 may then be moved to the retracted position and the crimped work piece may be removed from the work zone 43.

As illustrated in FIG. 7, each of the first undercut 46 and the second undercut 50 allow for the indenter 14 to fully return proximate to the body 22 of the clevis 12 which facilitates maximum capacity within the work zone 43.

Alternative embodiments of a crimper head may include elongated clevis legs to increase capacity within a work zone. As further illustrated in FIGS. 6 and 7, the width of the first slot 36 and the second slot 38 within the plane of the first inner surface 32 and the second inner surface 34, respectively, is maintained beyond the first ledge 48 and the second ledge 52, respectively. The constant width of the first slot 36 and the second slot 38 allow the indenter 14 to extend distally along the first and second legs 24, 26 beyond the ledges 48, 52 to maximize the traversable distance within the work zone 43. In particular, in an extended position, each of the arms 66, 68 of the indenter 14 are allowed to travel past each of the respective ends 80, 82 of the nest 16 when the nest 16 is in a locked position relative to the clevis 12 (e.g., see FIGS. 6 and 7).

In some embodiments, the crimper head 10 is constructed of metal. In some embodiments, the crimper head 10 is constructed of a lightweight metal, such as aluminum, magnesium, titanium, beryllium, and alloys thereof, for example. In some embodiments, the clevis 12 is constructed of a lightweight metal, such as aluminum.

The previous description of the disclosed embodiments is provided to enable any person skilled in the art to make or use the invention. Various modifications to these embodiments will be readily apparent to those skilled in the art, and the generic principles defined herein may be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. A crimper head for use in a tool, the crimper head comprising:

a clevis comprising:

a body having a cylindrical base and defining a base surface;

a first leg integrally formed with the cylindrical base and having a first inner surface and a first curved transition area adjacent to the base surface;

a second leg integrally formed with the cylindrical base and having a second inner surface and a second curved transition area adjacent to the base surface;

a first slot formed in the first leg that partially extends into the first inner surface; and a second slot formed in the second leg that partially extends into the second inner surface; and an indenter movable between a retracted position and an extended position in an axial direction, the indenter having a first arm disposed within the first slot and a second arm disposed within the second slot.

2. The crimper head of claim 1, wherein the indenter includes a base configured to engage the base surface of the body when the indenter is in the retracted position.

3. The crimper head of claim 1, wherein the first slot includes a first undercut extending below the base surface in the axial direction and the second slot includes a second undercut extending below the base surface in the axial direction.

4. The crimper head of claim 3, wherein the first arm is dimensioned to be seated within the first undercut and the second arm is dimensioned to be seated within the second undercut when the indenter is in the retracted position.

5. The crimper head of claim 1, wherein the clevis comprises aluminum.

6. The crimper head of claim 1, further comprising:

a nest defining a body extending between a first end and a second end, the body having an interior receiving area configured to face a work zone that is laterally bound by the first leg and the second leg;

a first fastener configured to releasably couple the first end of the nest to the first leg within the first slot; and a second fastener configured to pivotably couple the second end of the nest to the second leg within the second slot.

7. The crimper head of claim 1, wherein a work zone is bound laterally by the first leg and the second leg and the indenter maximizes the capacity of the work zone when in a retracted position.

8. The crimper head of claim 7, wherein the work zone is bound in the axial direction by the base surface of the clevis and by a nest.

9. The crimper head of claim 1, wherein the indenter is configured as a replaceable die.

10. A crimper head for use in a tool, the crimper head comprising:

a clevis with a first leg having a first slot and a second leg having a second slot, the first leg and the second leg extending from a cylindrical body having a base surface, wherein the first leg and the second leg integrally formed with the cylindrical body;

a nest releasably coupled to the first leg within the first slot; and an indenter with a body having a work surface and a base, the work surface on an opposing side of the body from the base, the base configured to engage the base surface of the cylindrical body when the indenter is in a retracted position.

11. The crimper head of claim 10, wherein the indenter is a unitary body and includes a first arm and a second arm radially extending from the body of the indenter and dimensioned to be seated with a respective first undercut formed in the first slot and a second undercut formed in the second slot when in the retracted position.

12. The crimper head of claim 11, wherein each of the first slot and the second slot have a constant width and are configured to receive the first arm and the second arm, respectively.

13. The crimper head of claim 10, wherein the clevis includes a first ledge formed in the first slot of the first leg and a second ledge formed in the second slot of the second leg, and wherein first and second legs of the nest are configured to be secured to the clevis adjacent to the respective first and second ledges.

14. The crimper head of claim 13, wherein each of the first ledge and the second ledge extend parallel to the base surface of the cylindrical body.

15. The crimper head of claim of claim 10, wherein the nest includes a pivot pin configured to rotatably secure the nest to the first leg and a nest pin configured to secure the nest in a closed position, and wherein when nest pin is removed from the nest, the nest is configured to be moved between the closed position and an open position.

16. The crimper head of claim 15, wherein the indenter is configured to be removed from the clevis when the nest is in the open position.

17. A crimper head for use in a tool, the crimper head comprising:

a clevis defining and clevis body and including:

first and second legs having respective first and second inner surfaces;

first and second slots formed at least partially in the respective first and second inner surfaces; and first and second ledges extending perpendicular to the respective first and second surfaces within the respective first and second slots;

a nest having a first end and a second end, each of the first and second ends configured to be secured to the clevis body adjacent to the respective first and second ledges; and an indenter moveable between a retracted position and an extended position and including first and second opposing arms, the first and second opposing arms configured to extend into the respective first and second slots and extend distally beyond the respective first and second ledges when the indenter is in the extended position.

18. The crimper head of claim 17, wherein the clevis body includes a base surface that extends parallel to each of the first and second ledges and a first and second transition areas between each of the respective first and second inner surfaces and the base surface, wherein the transition surfaces are configured to reduce stress concentrations in the clevis body.

19. The crimper head of claim 18, wherein the indenter defines an indenter base configured to engage the base surface of the clevis body when the indenter is in the retracted position.

20. The crimper head of claim 17, wherein the indenter is configured as an interchangeable indenter than can be removed from the clevis body.

* * * * *